US008302923B2

(12) United States Patent
Johnston et al.

(10) Patent No.: US 8,302,923 B2
(45) Date of Patent: Nov. 6, 2012

(54) MERCHANDISE DISPLAY HOOK HAVING PIVOTABLE LOCKING BASE

(75) Inventors: Michael Johnston, Waxhaw, NC (US); Jim Sankey, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 552 days.

(21) Appl. No.: 12/501,984

(22) Filed: Jul. 13, 2009

(65) Prior Publication Data

US 2011/0006181 A1 Jan. 13, 2011

(51) Int. Cl.
*A47B 96/06* (2006.01)

(52) U.S. Cl. ..... 248/220.41; 248/220.21; 248/221.11; 211/57.1; 70/14; 70/32

(58) Field of Classification Search ..... 248/220.21, 248/220.31, 220.41, 220.43, 221.11, 222.11, 248/222.13, 222.51, 222.52, 225.21, 243, 248/220.22, 220.42, 551; 211/57.1, 59.1, 211/7; 70/14, 32, 33, 34, 59, 60, 61, 62, 70/63, 57, 57.1, 276, 413
See application file for complete search history.

(56) References Cited

U.S. PATENT DOCUMENTS

| | | | | |
|---|---|---|---|---|
| 3,566,636 | A * | 3/1971 | Rudolf et al. | 70/276 |
| 3,926,395 | A * | 12/1975 | Lallement | 248/220.41 |
| 4,351,440 | A * | 9/1982 | Thalenfeld | 211/57.1 |
| 4,362,249 | A * | 12/1982 | Thalenfeld | 211/59.1 |
| 4,436,209 | A | 3/1984 | Thalenfeld | |
| 4,452,360 | A * | 6/1984 | Barnes | 211/59.1 |
| 4,512,481 | A | 4/1985 | Thalenfeld | |
| 4,516,681 | A * | 5/1985 | Jahel | 211/59.1 |
| 4,520,978 | A * | 6/1985 | Taub | 248/220.41 |
| 5,348,167 | A * | 9/1994 | Jensen | 211/57.1 |
| 5,769,373 | A | 6/1998 | Bond | |
| 5,855,347 | A * | 1/1999 | Hollingsworth et al. | 248/220.41 |
| 6,481,677 | B1 * | 11/2002 | Yu | 248/220.41 |
| 6,601,808 | B1 * | 8/2003 | Nagel | 248/220.31 |
| 6,957,555 | B1 * | 10/2005 | Nagel et al. | 70/57.1 |
| 7,178,678 | B2 | 2/2007 | Mansfield et al. | |
| 2003/0071181 | A1 * | 4/2003 | Valiulis et al. | 248/220.43 |
| 2007/0012832 | A1 * | 1/2007 | Ottens et al. | 248/220.41 |
| 2008/0169250 | A1 * | 7/2008 | Nagelski | 211/7 |
| 2009/0173853 | A1 * | 7/2009 | Fawcett et al. | 248/220.31 |

FOREIGN PATENT DOCUMENTS

| | | | |
|---|---|---|---|
| EP | 0075225 | A2 | 3/1983 |
| WO | 0132061 | A2 | 5/2001 |
| WO | 03070066 | A1 | 8/2003 |
| WO | 03080972 | A1 | 10/2003 |
| WO | 2005049944 | A2 | 6/2005 |
| WO | 2008088679 | A1 | 7/2008 |

* cited by examiner

*Primary Examiner* — Kimberly Wood
(74) *Attorney, Agent, or Firm* — Christopher C. Dremann, P.C.

(57) ABSTRACT

A merchandise display hook includes a display rod and a locking base pivotally attached to the display rod for locking the display hook on a display support. The locking base is configured to pivot relative to the display rod inwardly towards the display support from an unlocked position to a locked position and outwardly from the display support from the locked position to the unlocked position. The display hook includes a first attachment member configured to engage a front surface of the display support and a second attachment member configured to engage a rear surface of the display support. The locking base defines a contact surface configured to engage the front surface of the display support in the locked position. When the locking base is in the locked position, the locking base and the display rod define a first angle therebetween. When the locking base is in the unlocked position, the locking base and the display rod define a second angle therebetween that is less than the first angle.

11 Claims, 6 Drawing Sheets

MERCHANDISE DISPLAY HOOK HAVING PIVOTABLE LOCKING BASE

BACKGROUND OF THE INVENTION

This invention relates generally to merchandise display hooks for supporting and displaying items of merchandise. More particularly, the invention relates to a merchandise display hook having a pivotable locking base. In preferred embodiments, the invention is a merchandise display hook that is mounted on and lockable to a generally vertical display support. The display hook includes a base that is pivotable between an unlocked position and a locked position. The base is configured to pivot outwardly from the display support relative to the display hook about a pivot crossbar and includes a movable latch mechanism that is operated by a magnetic key.

It is common practice for retailers to display relatively small, relatively expensive items of merchandise on display hooks mounted on a generally vertical display support, such as pegboard, slot-wall or slat-wall, bar rack, wire grid or the like. Each display hook includes a display arm, wire or rod (hereinafter collectively referred to as "display rod") that extends outwardly away from the display support and is attached to an attachment member operable for suspending the display rod from the display support in a cantilevered fashion.

When a merchandise display hook is mounted on a type of display support commonly known as pegboard, the attachment member of the display hook passes through one or more apertures formed in the pegboard and engages a rear surface of the pegboard. Typically, the display hook is first angled upwardly relative to the plane of the pegboard so that the attachment member can be passed through the aperture(s). The display hook is then rotated downwardly relative to the plane of the pegboard so that the attachment member engages the rear surface of the pegboard. The process is essentially reversed to remove the display hook from the pegboard. In particular, the display hook is rotated upwardly relative to the plane of the pegboard so that the attachment member can be withdrawn through the aperture(s).

A display hook allows a potential purchaser to view an item of merchandise prior to purchasing the item. At the same time, the display hook permits the retailer to stock multiple items of merchandise on each of several display hooks in a limited amount of space, thereby increasing the number of items displayed on the display support, while reducing the need to repeatedly stock the items. The large number of relatively small and relatively expensive items, however, makes the merchandise an attractive target for shoplifters. A shoplifter might attempt to discretely remove only one item of merchandise at a time from the display rod of the display hook. More likely, however, a shoplifter will attempt to remove all of the items of merchandise at once by "sweeping" the items off of the free end of the display rod or by removing the entire display hook from the display support.

It is known to counter the latter shoplifting technique by locking or otherwise fixing the display hook to the display support. One conventional method of fixing a display hook to a display support requires the use of a screw or other fastener to mechanically secure the display hook to the display support. A disadvantage with such a method is that the fastener may prove difficult to remove, thereby damaging the display support and possibly rendering it unavailable for use with the same or a different display hook.

A known method of locking a display hook to a display support is to provide the display hook with a locking base. To prevent a shoplifter from removing the display hook, the locking base is positioned against the display support and locked in place, such that the display hook cannot be rotated relative to the display support to withdraw the attachment member from the aperture(s).

Locking bases configured to move between a locked position and an unlocked position by sliding along the length of the display rod are known. One disadvantage with certain locking bases that slide along the display rod is that the items of merchandise must be removed from the display rod before the locking base can be unlocked and the display hook can be removed from the display support. In this regard, the display hooks cannot be repositioned readily to provide space for new display hooks, or to reconfigure existing display hooks on the display support.

Locking bases that permit the display hook to move out of engagement with the display support by rotating the locking base parallel to the plane of the display support to one side of the display hook, e.g., sideways away from the display rod and attachment member, are also known. A problem with rotating locking bases is that the locking base must be positioned off to the side of the display rod to disengage the display hook from the display support. For a display in which multiple merchandise hooks are positioned side-by-side and stocked with merchandise, moving a locking base to the side of the display rod typically interferes with other display hooks. In this regard, rotating the locking base sideways relative to the display rod of the display hook might cause the locking base to contact merchandise on adjacent display hooks, and possibly prevent the display hook from being removed from the display support.

Accordingly, there exists an unresolved need for a merchandise display hook having an improved locking base for locking the display hook to a display support, while permitting the display hook to be removed from the display support without removing the items of merchandise displayed on the display hook. There also exists an unresolved need for a merchandise display hook having an improved locking base for locking the display hook to a display support that can be removed from the display support without the locking base interfering with an adjacent display hook.

SUMMARY OF THE INVENTION

The aforementioned needs, objectives, and advantages, as well as others readily apparent to those of ordinary skill in the art are provided by a merchandise display hook for supporting and display items of merchandise that can be locked to a generally vertical display support, such as pegboard, slot-wall or slat-wall, bar rack, wire grid, or the like, in accordance with the invention. The display hook includes a display rod and a locking base pivotally attached to the display rod for locking the display hook to a display support. The locking base is configured to pivot relative to the display rod inwardly towards the display support from an unlocked position to a locked position and outwardly from the display support from the locked position to the unlocked position.

In one aspect, the invention provides a merchandise display hook for supporting and displaying items of merchandise on a display support. The display hook including a display rod having a support end for attachment to the display support and a locking base pivotally attached to the display rod at the support end for locking the display hook to the display support. The display hook further including first and second attachment members provided at the support end of the display rod, one of the first and second attachment members provided on the locking base and the other of the first and second attachment members provided on the display rod.

According to one embodiment, the first attachment member is configured to engage a front surface of the display support and the second attachment member is configured to engage a rear surface of the display support.

According to another embodiment, the locking base is pivotable inwardly towards the display support relative to the display rod from an unlocked position to a locked position and is pivotable outwardly from the display support relative to the display rod from the locked position to the unlocked position.

According to another embodiment, the locking base and the display rod define a first angle therebetween when the locking base is in the locked position and define a second angle therebetween when the locking base is in the unlocked position.

According to another embodiment, the first angle is greater than the second angle.

According to another embodiment, the display further includes a pivot crossbar rigidly attached to the display rod and the locking base pivots relative to the display rod about the pivot crossbar.

According to another embodiment, the locking base defines a contact surface configured to engage a front surface of the display support in the locked position.

According to another embodiment, the first attachment member is configured to move relative to the display rod when the locking base is moved between the locked position and the unlocked position.

According to another embodiment, the second attachment member is configured to move relative to the display rod when the locking base is moved between the locked position and the unlocked position.

According to another embodiment, the locking base includes a latch mechanism that is movable between a latched position and an unlatched position.

According to another embodiment, the display hook further includes a latch crossbar rigidly attached to the display rod and the latching shuttle is disposed between the latch crossbar and a front surface of the display support in the latched position.

According to another embodiment, the latching shuttle is biased in the latched position by a biasing force exerted on the latching shuttle.

According to another embodiment, the latching shuttle of the latch mechanism is made of a magnetically attractable material and is operable to be moved from the latched position to the unlatched position by a magnetic key.

According to another embodiment, the latching shuttle is moved from the latched position to the unlatched position by a magnetic force field sufficient to overcome the biasing force exerted on the latching shuttle by the biasing spring.

In another aspect, the invention provides a method for removably locking a display hook to a display support. The method includes providing a merchandise display hook including a display rod having a support end adjacent the display support, a locking base pivotally attached to the display rod at the support end and pivotable relative to the display rod between an unlocked position and a locked position, and first and second attachment members positioned at the support end of the display rod. The method further includes positioning the locking base in the unlocked position. The method further includes engaging at least one of the first and second attachment members with the display support. The method further includes pivoting the locking base from the unlocked position to the locked position such that a contact surface defined by the locking base engages a front surface of the display support.

According to one embodiment, the locking base includes a latch mechanism that is movable between a latched position and an unlatched position and the method further includes moving the latch mechanism from the latched position to the unlatched position.

According to another embodiment, the latch mechanism is made of a magnetically attractable material and the method further includes operating a magnetic key to move the latch mechanism from the latched position to the unlatched position.

According to another embodiment, the method further includes pivoting the locking base from the locked position back to the unlocked position.

According to another embodiment, the method further includes disengaging the first and second attachment members from the display support to remove the display hook from the display support.

BRIEF DESCRIPTION OF THE DRAWINGS

The present invention is better understood with reference to the following detailed description in conjunction with the accompanying figures.

DETAILED DESCRIPTION OF THE PREFERRED EMBODIMENTS

Figure 1:
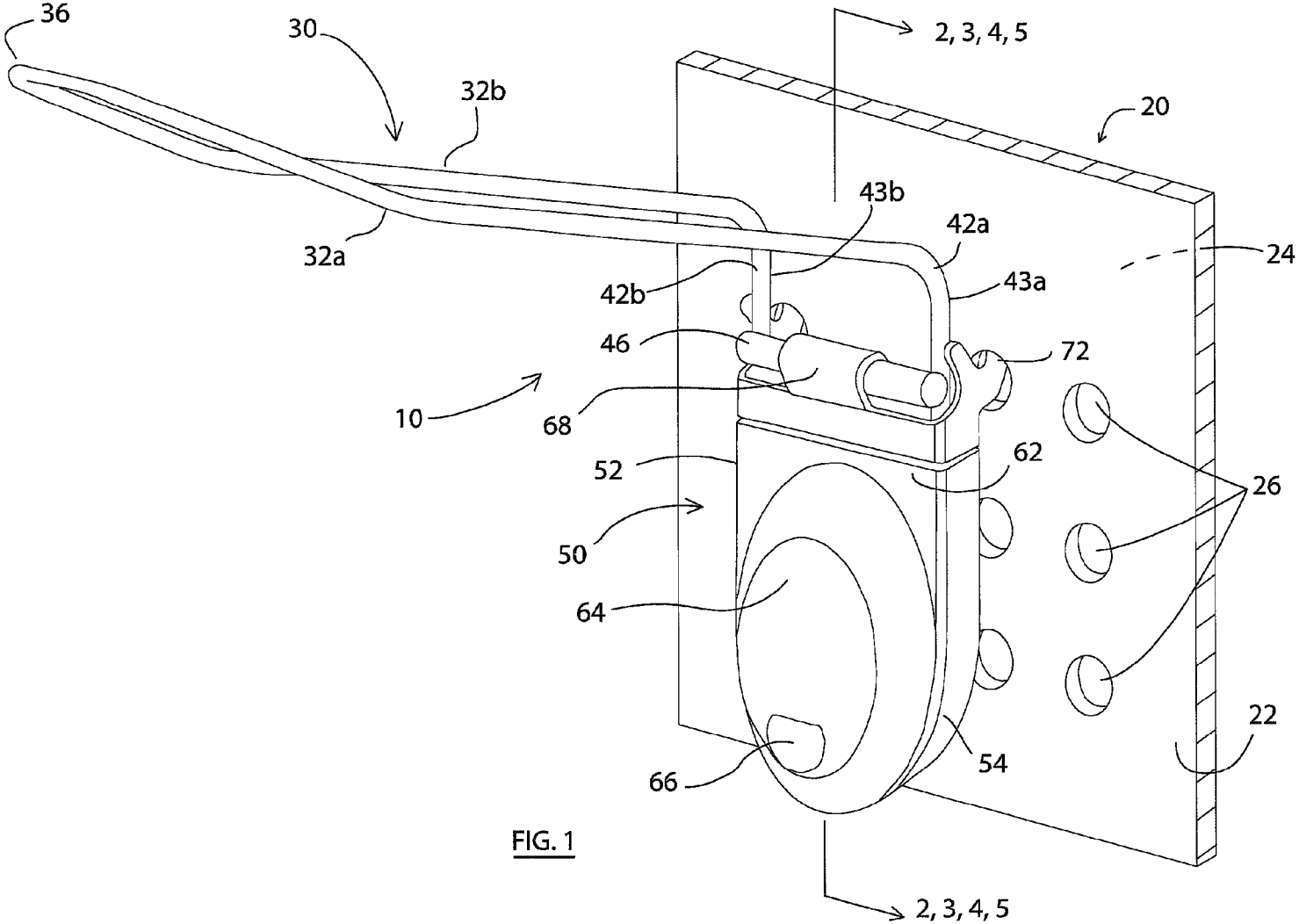
FIG. 1 is a perspective front view of an exemplary embodiment of a merchandise display hook including a pivotable locking base for locking the display hook to a display support in accordance with the invention.

Referring now to the accompanying drawings wherein identical reference numerals denote like elements throughout the various views, an exemplary embodiment of a merchandise display hook, indicated generally at 10, having a pivotable locking base, indicated generally at 50, for locking the display hook to a display support, indicated generally at 20, is shown in FIGS. 1-5. The display hook 10 is configured to display one or more items of merchandise (not shown) on a generally vertical display support 20, such as a pegboard, slot-wall or slat-wall, bar rack, wire grid or the like. As shown, display support 20 is a conventional pegboard. Pegboard 20 has a front surface 22 and a rear surface 24. At least one, and preferably a plurality of apertures 26 are formed through the pegboard 20 and extend between front surface 22 and rear surface 24.

As shown, display hook 10 comprises a display rod, indicated generally at 30, and locking base 50 pivotally attached to the display rod. Display rod 30 has an outer free end 36 that extends outwardly from an inner support end 38 configured for attaching the display rod to the pegboard 20. In the illustrated exemplary embodiment, display rod 30 is symmetrical about a center plane perpendicular to the generally vertical plane defined by the pegboard 20. The display rod 30 comprises a first rod 32*a* and a second rod 32*b* joined at free end 36. First rod 32*a* is essentially identical to second rod 32*b*. Accordingly, the elements associated with first rod 32*a* will be readily understood and appreciated by those skilled in the art from the detailed description of the corresponding elements associated with second rod 32*b*. Likewise, the detailed description of elements associated with first rod 32*a* is equally applicable to the corresponding elements associated with second rod 32*b*.

At support end 38, display rod 30 comprises first leg 42*a* and second leg 42*b*. In this regard, first rod 32*a* is rigidly, and preferably, integrally connected to leg 42*a* at support end 38*a*. Similarly, second rod 32*b* is connected to leg 42*b* at support end 38. Leg 42*a* defines a first attachment member 43*a* that extends from the first rod 32*a* downwardly towards a distal portion of support end 38. Similarly, corresponding first attachment member 43*b* defined by leg 42*b* extends downwardly from second rod 32*b* towards the distal portion of support end 38. A pivot crossbar 46 is rigidly attached to (for example by welding, brazing or fusing) and extends between leg 42*a* and leg 42*b*. Pivot crossbar 46 is positioned medially between first attachment members 43*a*, 43*b* and the distal portion of support end 38, nearer to the first attachment members. Similarly, a latch crossbar 48 is rigidly attached to (for example by welding, brazing or fusing) and extends between leg 42*a* and leg 42*b*. Latch crossbar 48 is positioned medially between crossbar 46 and the distal portion of support end 38, nearer to the distal portion of the support end.

Locking base 50 comprises a generally hollow housing 52 and a latch mechanism, indicated generally at 80. As shown, housing 52 includes a generally U-shaped sidewall 54 having an arcuate (i.e. curved) lower end and a linear (i.e. straight) upper end. Housing 52 also includes an outer wall 61 that extends laterally between the U-shaped sidewall 54 and defines a generally planar surface portion 62. Outer wall 61 further defines a raised surface portion 64 projecting outwardly from planar surface portion 62. A key recess 66 is defined by outer wall 61 and extends inwardly into the housing 52 from raised surface portion 64.

Sidewall 54 defines a rear contact surface 55 that is positioned along the inner edge of the sidewall opposite outer wall 61. In the illustrated embodiment, contact surface 55 defines a plane that is generally parallel to the plane defined by first attachment members 43*a* and 43*b* of first and second rods 32*a* and 32*b*, respectively, when the locking base 50 is in the locked position, as will be described. Contact surface 55 is operable for engaging the front surface 22 of display support 20 with the locking base 50 in the locked position. It should be appreciated that contact surface 55 can include multiple surfaces defined by projections from housing 52 of locking base 50. By way of example and not limitation, such projections from housing 52 can be in the form of feet, undulations, tabs, posts, pegs and the like suitable for defining a contact area that engages front surface 22 of display structure 20 with the locking base in the locked position. As used herein, the term "engaging" is intended to mean that the first element recited is in contact with, or nearly in contact with, the second element recited, such that movement of the display hook 10 relative to the display support (i.e. pegboard) 20 is restricted.

Locking base 50 also includes a clip or clasp 68 adjacent the upper end of the locking base that depends from the planar surface portion 62 of the outer wall 61 towards the pivot crossbar 46. Clasp 68 defines a hook end that is dimensioned to receive pivot crossbar 46. At least one peg, referred to herein as an antler 72, extends inwardly from sidewall 54 adjacent the upper end of the locking base 50. As shown, a pair of antlers 72 are positioned on the sidewall 54 symmetrically of the clasp 68. In this regard, each antler 72 defines a portion of a second attachment member 74 and a portion of an auxiliary attachment member 76. The auxiliary attachment member 76 is spaced-apart from the corresponding second attachment member 74 to define a notch 78 therebetween. Notch 78 is configured to be received within an aperture 26 of the pegboard 20 when antler 72 is passed through the aperture, such that second attachment member 74 engages rear surface 24 of the pegboard and auxiliary attachment member 76 engages the front surface 22 of pegboard 20.

Figure 3:
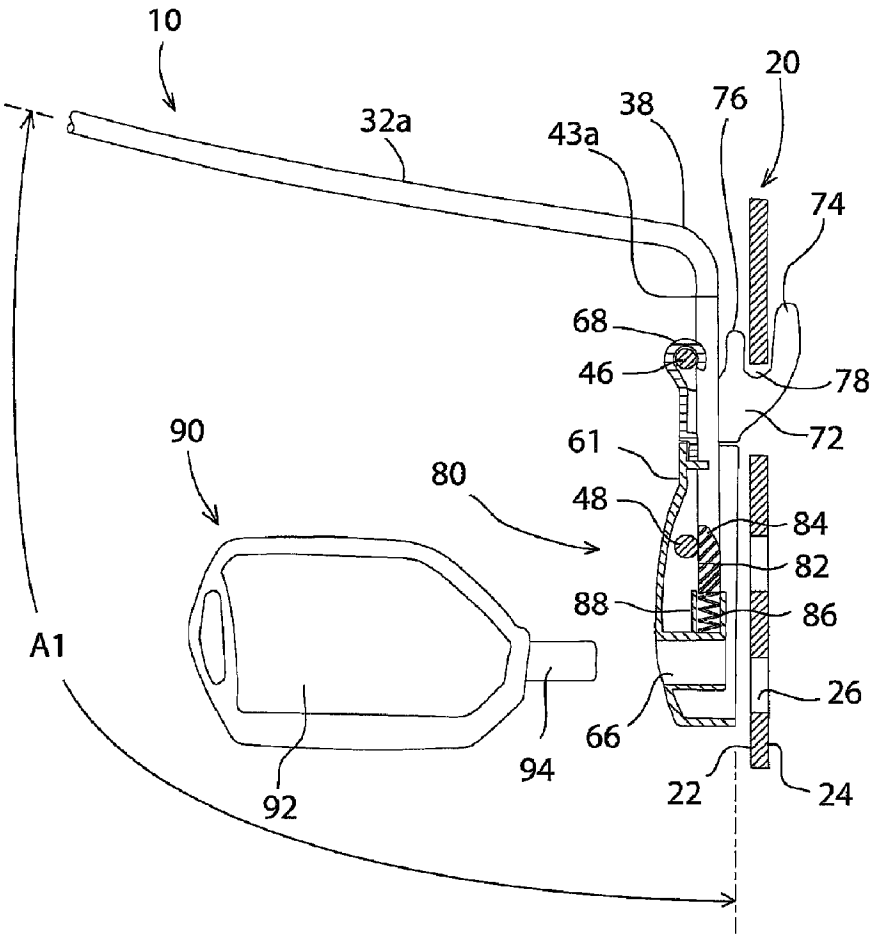
FIG. 3 is a partial section side view of the display hook and display support of FIG. 1 showing the locking base in a locked position and the latch mechanism in a latched position with a magnetic key positioned adjacent a recess formed in the locking base.

Latch mechanism 80 includes a latching shuttle 82 that is positioned within a shuttle recess or pocket 88 formed within housing 52 of locking base 50. A biasing spring 86 positioned between the shuttle pocket 88 and the latching shuttle 82 is operable for biasing the latching shuttle in the direction of the upper end of the housing 52. As shown, latching shuttle 82 has a tapered nose portion 84 opposite the biasing spring 86 that defines a cam surface for contacting latch crossbar 48. In the illustrated embodiment, the tapered nose portion 84 is configured to urge the latching shuttle 82 downwardly against the upward force of biasing spring 86 upon contact with the latch crossbar 48. In the illustrated embodiment, latching shuttle 82 is configured to move between an unlatched position outward of the latch crossbar 48 in which the latching shuttle is extended by the biasing spring 86 (FIG. 2), and a latched position inward of the latch crossbar in which the latching shuttle is extended by the biasing spring and the locking base is restrained with the contact surface 55 against the front surface 22 of the display support 20 (FIG. 3). Intermediate the unlatched position and the latched position, the biasing spring 86 is collapsed and the latching shuttle 82 is not restrained by latch crossbar 48 so that the locking base 50 can be moved from the locked position to the unlocked position (FIG. 4), as will be described.

Figure 4:
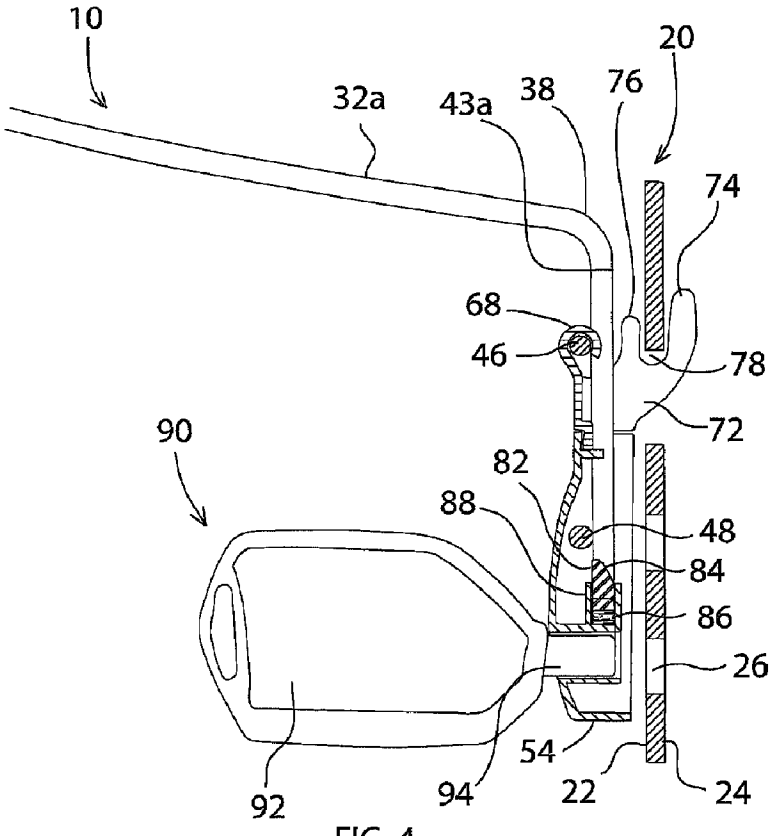
FIG. 4 is a partial section side view of the display hook and display support of FIG. 1 showing the locking base in the locked position and the latch mechanism in the unlatched position, with the magnetic key inserted in the recess of the locking base.

A key, indicated generally at 90, is provided to actuate the latching shuttle 82 from its normally extended configuration as a result of the biasing force of biasing spring 86 and a retracted configuration in order to move the latching shuttle from the latched position to the unlatched position. As shown, the key 90 comprises a body 92 and an actuator 94 that is sized and shaped to be received within recess 66 formed in housing 52 of locking base 50. When actuator 94 of key 90 is inserted within recess 66 of housing 52, as shown in FIG. 4, the latching shuttle 82 is moved from the latched position shown in FIG. 3 to the unlatched position shown in FIG. 4. Preferably, key 90 and latching shuttle 82 are configured to interact as a result of a magnetic force field. In particular, key 90 is a magnetic key wherein actuator 94 is magnetized and latching shuttle 82 is made of a magnetically attractable material. It should be appreciated that actuator 94 of key 90, latching shuttle 82, or both can be magnetized. It should also be appreciated that known mechanical key and latch configurations, for example a common lock and tumbler, can be used to move latching shuttle 82 from the latched position to the unlatched position.

Figure 2:
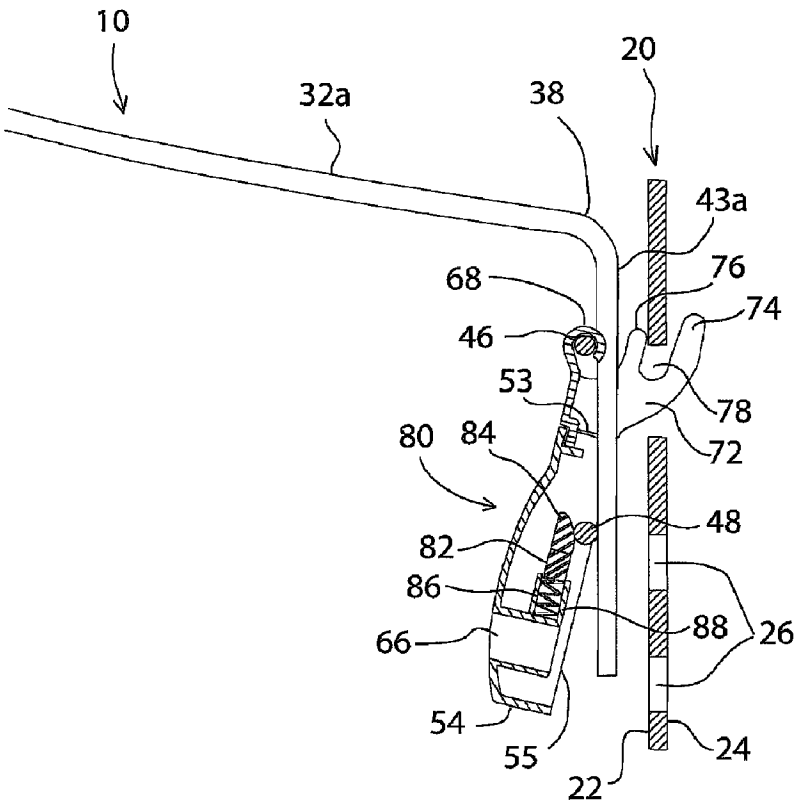
FIG. 2 is a partial section side view of the display hook and display support of FIG. 1 showing the locking base in an unlocked position and a latch mechanism of the locking base in an unlatched position.

As previously mentioned, locking base 50 is configured to move, and more particularly, to pivot between a locked position and an unlocked position. Actuation of latch mechanism 80 is necessary for locking base 50 to be pivoted from the locked position to the unlocked position. FIG. 2 shows the locking base 50 in the unlocked position as the display hook 10 is being mounted on the pegboard 20. In particular, locking base 50 is pivoted outwardly and antlers 72 are passed through corresponding apertures 26 in pegboard 20. Locking base 50 is then rotated downwardly towards pegboard 20 such that second attachment members 74 are seated adjacent the rear surface 24 of pegboard 20. The latching shuttle 82 is biased upwardly by the biasing spring 86 within the shuttle pocket 88 and the tapered nose portion 84 of the latching shuttle rests against the curved outer surface of the latch crossbar 48. Further rotation of the locking base 50 towards the pegboard 20 causes the latching shuttle 82 to ride under latch crossbar 48 overcoming the upward force exerted by the biasing spring 86 until the latching shuttle passes behind the latch crossbar.

FIG. 3 shows the locking base 50 in the locked position with the latching shuttle 82 behind the latch crossbar 48 and fully extended by the biasing spring 86. In this regard, the latch crossbar 48 is positioned between the latching shuttle 82 and the outer wall 61 of housing 52. With latching shuttle 82 biased by biasing spring 86 in the latched position, locking base 50 cannot be moved from the locked position to the unlocked position without the use of key 90. Furthermore, with latching shuttle 82 in the latched position and locking base 50 in the locked position, first attachment members 43*a* and 43*b* engage (i.e. are positioned generally parallel to and in contact with, or nearly in contact with) front surface 22 of pegboard 20. Similarly, second attachment members 74 of antlers 72 engage (i.e. are positioned generally parallel to and in contact with, or nearly in contact with) rear surface 24 of pegboard 20. Auxiliary attachment members 76 may also engage front surface 22 of pegboard 20. As a result, pegboard 20 is maintained between first attachment members 43*a*, 43*b* and second attachment members 74. Thus, display hook 10 cannot be removed from the pegboard 20 without first moving the latching shuttle 82 from the latched position to the unlatched position, and then moving the locking base 50 from the locked position to the unlocked position.

Figure 5:
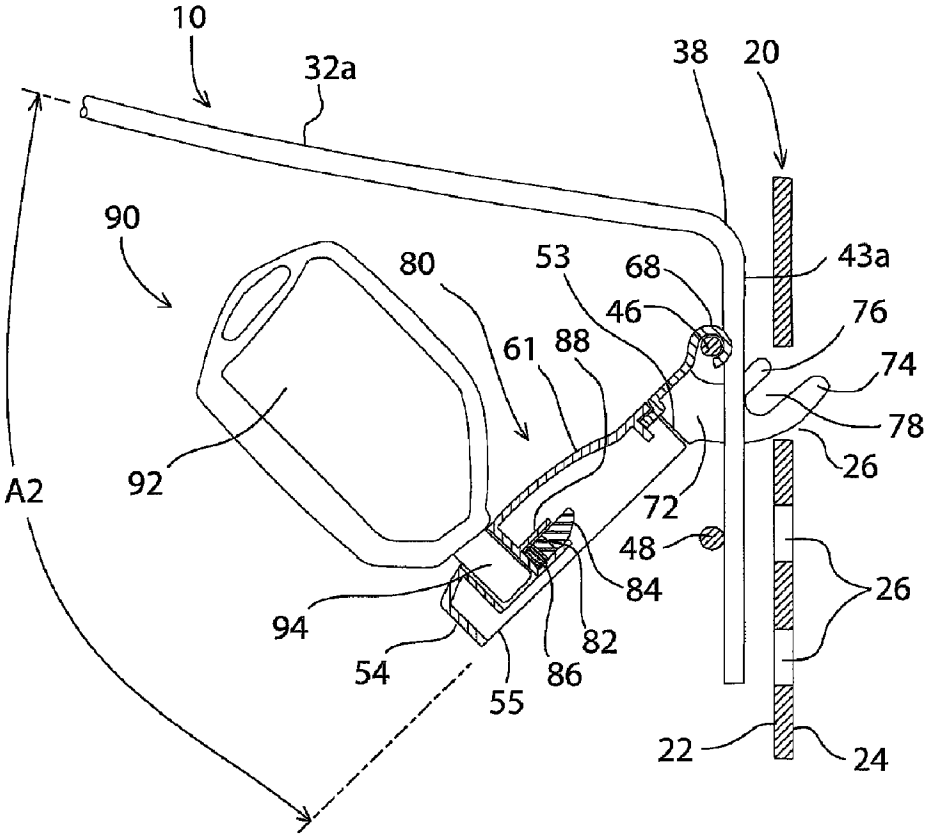
FIG. 5 is a partial section side view of the display hook and display support of FIG. 1 showing the locking base in the unlocked position and the latch mechanism in the unlatched position, with the magnetic key still inserted in the recess of the locking base.

FIG. 4 shows the actuator 94 of key 90 inserted into the recess 66 formed in the housing 52 of the locking base 50 and the latching shuttle 82 attracted by the magnetic force field to overcome the biasing force exerted by the biasing spring 86. As such, the biasing spring 86 is compressed and the latching shuttle 82 is moved below the latch crossbar 48. In this configuration, the locking base 50 can be moved from the locked position (FIG. 3) to the unlocked position (FIG. 5) by pivoting the clasp 68 of the locking base about the pivot crossbar 46. As shown in FIG. 5, second attachment members 74 of the antlers 72 are moved out of engagement with the rear surface 24 of pegboard 20 as the locking base 50 moves from the locked position to the unlocked position. Thus, the display hook 10 can be removed from the pegboard 20 by withdrawing the antlers 72 of the locking base 50 through the apertures 26 of the pegboard.

Figure 6:
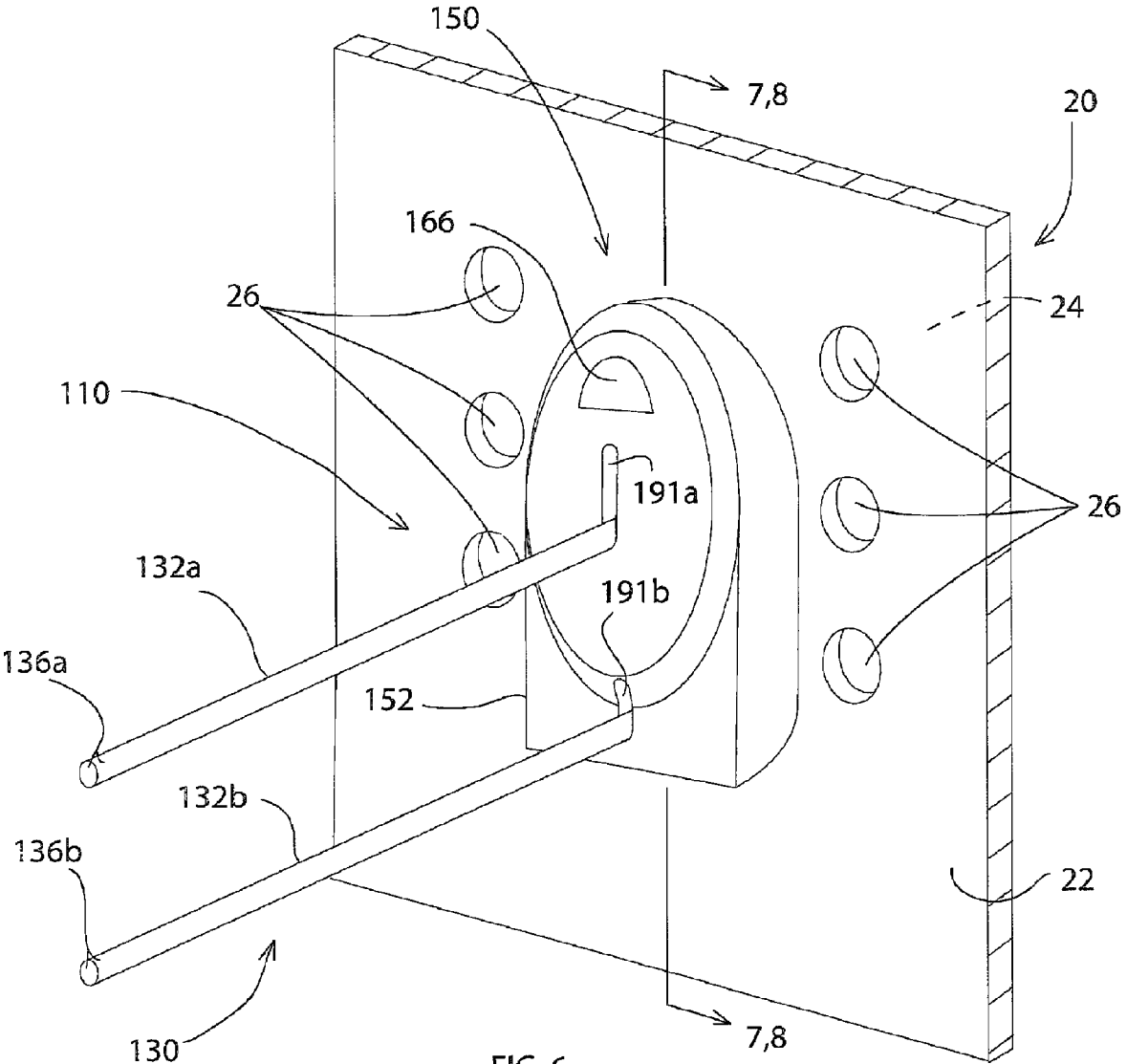
FIG. 6 is a perspective front view of another exemplary embodiment of a merchandise display hook having a pivotable locking base for locking the display hook to a display support in accordance with the invention.
Figure 8:
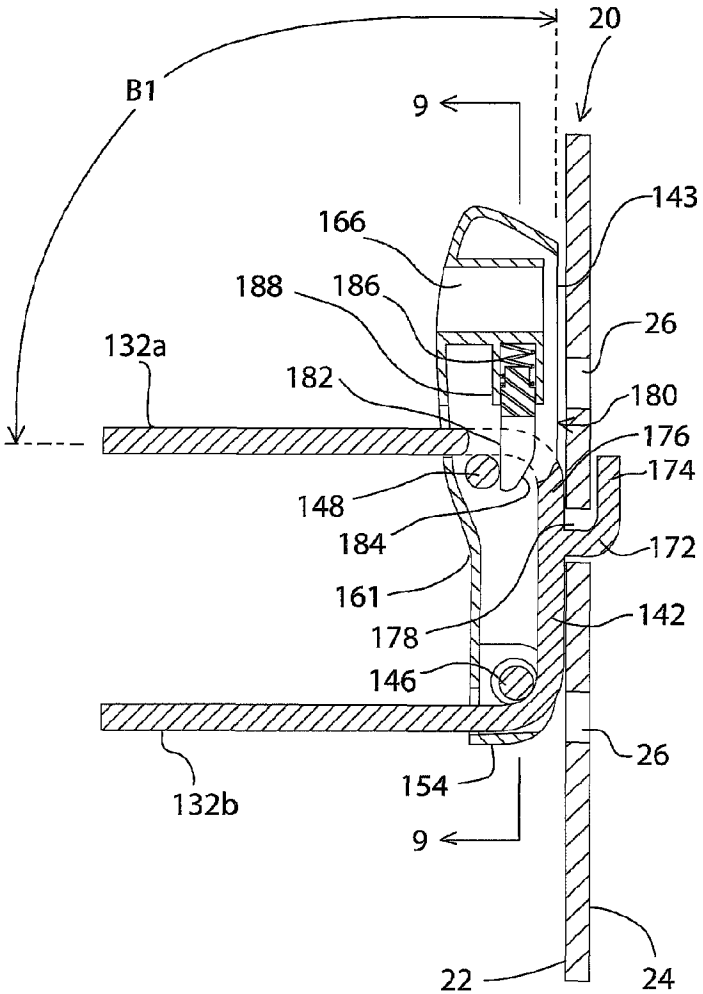
FIG. 8 is a partial section side view of the display hook and display support of FIG. 6 showing the locking base in a locked position and the latch mechanism in a latched position.
Figure 7:
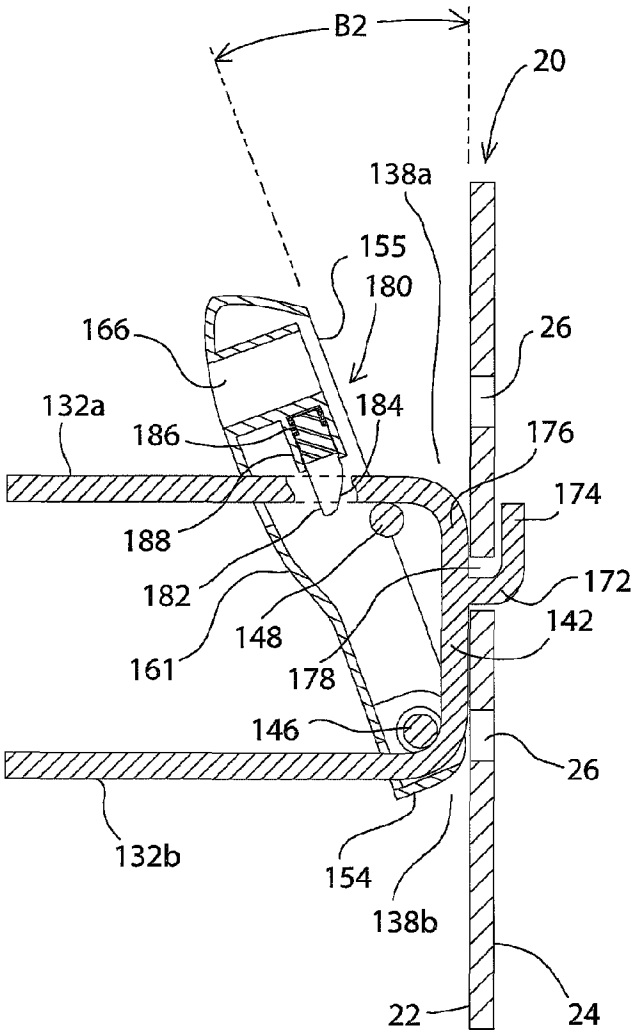
FIG. 7 is a partial section side view of the display hook and display support of FIG. 6 showing the locking base in an unlocked position and a latch mechanism of the locking base in an unlatched position.

FIGS. 6, 7, and 8 show another exemplary embodiment of a merchandise display hook, indicated generally at 110 in accordance with the invention. Display hook 110 includes elements that are analogous to corresponding elements of merchandise display hook 10, and as such, are indicated by like reference numbers incremented by 100 (e.g. display hook 110 corresponds to display hook 10). Elements associated with display hook 110 that are not described herein can be generally understood by the description of the analogous element associated with display hook 10. Display hook 110 comprises a display rod 130 having an upper rod 132*a* and a lower rod 132*b*. In the illustrated embodiment, rods 132*a* and 132*b* each have a free end 136*a* and 136*b*, respectively. Upper rod 132*a* and lower rod 132*b* extend outwardly from respective support ends 138*a* and 138*b* configured for attachment to display support 20. Upper rod 132*a* and lower rod 132*b* are joined together by connecting rod 142 to form conventional display rod 130 commonly referred to as a "2-wire" display rod.

A pivot crossbar 146 is rigidly attached to (for example by welding, brazing or fusing) display rod 130 adjacent support end 138*b* and a latch crossbar 148 is likewise rigidly attached to (for example by welding, brazing or fusing) the display rod adjacent support end 138*a*. As shown, at least one antler 172 is rigidly attached to connecting rod 142 medially between upper rod 132*a* and lower rod 132*b*. Antler 172 comprises a second attachment member 174 and is configured to be passed through an aperture 26 of the pegboard 20 such that the second attachment member engages (i.e. is in contact with, or nearly in contact with) the rear surface 24 of pegboard 20, as previously described. Connecting rod 142 defines an auxiliary attachment member 176 opposite second attachment member 174 such that a notch 178 is formed therebetween, as previously described.

Locking base 150 comprises a housing 152 having a generally U-shaped sidewall 154 defined by a linear (i.e. straight) lower end and an arcuate (i.e. curved) upper end opposite the lower end. An outer wall 161 extends between the U-shaped sidewall 154 and an inner contact surface 155 (FIG. 7) likewise extends between an inner edge of the sidewall opposite the outer wall, essentially as previously described. In the illustrated embodiment, contact surface 155 defines a plane that is generally parallel to the plane defined by connecting rod 142 of display rod 130 when the locking base 150 is in the locked position, as will be described. Contact surface 155 further defines first attachment member 143 (FIG. 8) that is operable for engaging the front surface 22 of pegboard 20 with the locking base 150 in the locked position. It should be appreciated that contact surface 155 can include multiple surfaces defined by projections from housing 152 of locking base 150. By way of example and not limitation, such projections from housing 152 can be in the form of feet, undulations, tabs, posts, pegs and the like suitable for defining a contact area for first attachment member 143 to engage front surface 22 of pegboard 20 with the locking base 150 in the locked position. In the locked position, first attachment member 143 is in contact with, or nearly in contact with, front surface 22 of the pegboard 20 and the second attachment member 174 is in contact with, or nearly in contact with, the rear surface 24 of the pegboard 20, such that the display hook 110 is restrained by the pegboard between the first attachment member and the second attachment member.

Figure 9:
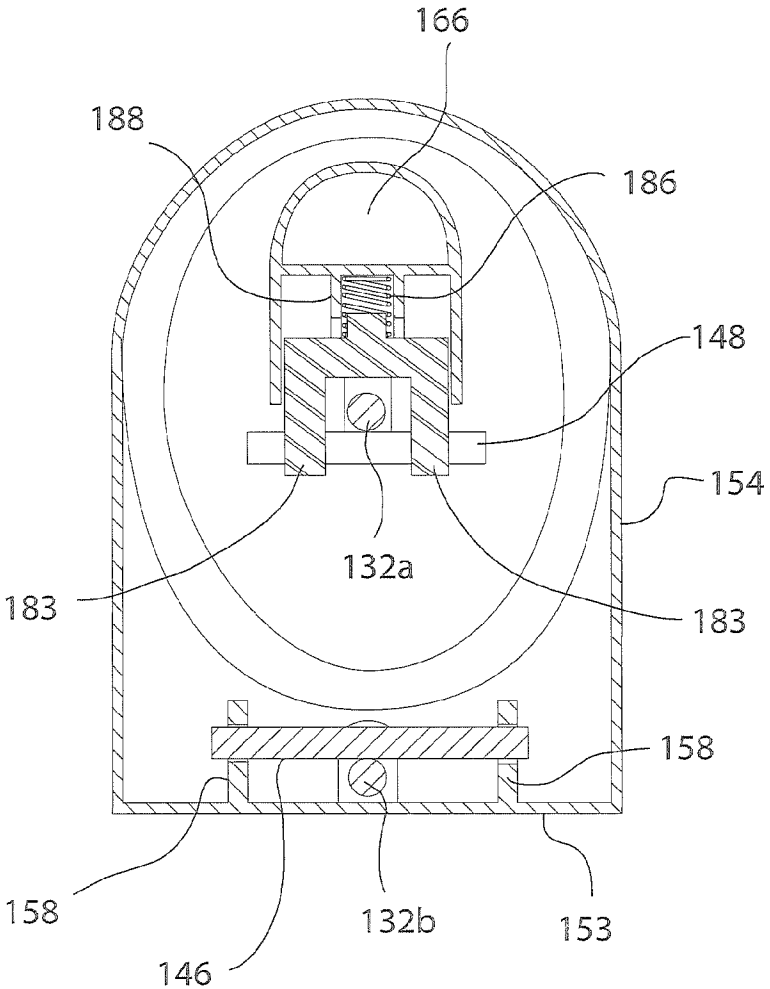
FIG. 9 is a partial section rear view of the display hook of FIG. 8 showing the locking base in the locked position and the latch mechanism in the latched position.

Locking base 150 is movable between the unlocked position shown in FIG. 7 and the locked position shown in FIG. 8 in substantially the same manner as shown in FIGS. 2-5 and described with respect to the locking base 50. Slots 191*a* and 191*b* are formed through housing 152 of locking base 150 to receive the respective upper rod 132*a* and lower rod 132*b* therein and are configured to permit movement of locking base 150 between the unlocked position and the locked position. As shown in FIGS. 7 and 8, locking base 150 comprises a latch mechanism 180 having a latching shuttle 182 disposed within a shuttle recess or pocket 188, essentially as previously described. As shown in FIG. 9, latching shuttle 182 is generally "horseshoe" or "wishbone" shaped and comprises a pair of latching legs 183 disposed on either side of upper rod 132*a*, Such that upper rod 132*a* does not interfere with latching shuttle 182. Consequently, locking base 150 is free to move between the unlocked and locked positions. In accordance with this embodiment of the invention, locking base 150 defines first attachment member 143, while antler(s) 172 of display rod 130 define second attachment member(s) 174. As such, first attachment member 143 and second attachment member(s) 174 are spaced apart sufficiently to define a gap therebetween configured to receive a portion of pegboard 20 when antler(s) 172 of display rod 130 are passed through the corresponding aperture(s) 26 of pegboard 20 and locking base 150 is in the locked position shown in FIG. 8. As a result, display hook 110 cannot be removed from display support 20 with locking base 150 in the locked position. Movement of locking base 150 between the locked position and the unlocked position can be understood from the corresponding description of the movement of locking base 50 of display hook 10 between the locked position and the unlocked position.

As will be readily appreciated from the foregoing detailed description of the exemplary embodiments, a merchandise display hook according to the invention includes a locking base 50 or a locking base 150 that is configured to pivot outwardly away from the display support 20 relative to display rod 30 or display rod 130, respectively. In this regard, locking base 50 defines a first angle A1 with respect to display rod 30 when locking base 50 is positioned in the locked position (FIG. 3). More specifically, contact surface 55 of housing 52 defines a plane disposed at a predetermined angle A1 relative to the plane defined by first rod 32*a* and second rod 32*b* of display rod 30. In the same manner, locking base 50 defines a second angle A2 with respect to display rod 30 when locking base 50 is positioned in the unlocked position (FIG. 5). Locking base 150 defines an analogous first angle B1 with respect to the display rod 130, and more specifically with respect to lower rod 132*b*, when locking base 150 is positioned in the locked position (FIG. 8). In the same manner, locking base 150 defines a second angle B2 (analogous to second angle A2) when locking base 150 is positioned in the unlocked position (FIG. 7). Locking base 50 and locking base 150 are each configured to pivot relative to its corresponding display rod 30 and 130, respectively, about the corresponding pivot crossbar 46 and 146, respectively, between the unlocked and locked positions. As shown and described herein, the first angles A1 and B1 are greater than the second angles A2 and B2, respectively. However, it will be readily appreciated that the display hook 10, 110 can be configured such that either or both of the first angles A1 and B1 are less than the corresponding second angles A2 and B2.

The invention can be better understood and appreciated with reference to a description of the operation thereof. The operation of the invention is described herein with respect to display hook 10 shown in FIGS. 1-5. It will be readily understood and appreciated by those skilled in the art that the operation of display hook 110 is essentially analogous to the operation of display hook 10. Accordingly, only the operation of display hook 10 will be described herein and the operation of display hook 110 should be understood from the description of the operation of display hook 10.

The invention provides a method for removably locking merchandise display hook 10 on a generally vertical display support 20, and as shown and described herein, on a conventional pegboard. The display hook 10 is first positioned adjacent the pegboard 20 with the locking base 50 pivoted outwardly from the pegboard relative to the display rod 30 to the unlocked position shown in FIG. 5. In the unlocked position, the antlers 72 of the locking base 50 can be passed through the corresponding apertures 26 formed in the pegboard such that first attachment members 43*a* and 43*b* engage the front surface 22 of pegboard 20. Locking base 50 is then pivoted inwardly towards the pegboard relative to display rod 30 about pivot crossbar 46 to the unlocked and unlatched position shown in FIG. 2 such that second attachment members 74 engage the rear surface 24 of pegboard 20 and auxiliary attachment members 76 engage the front surface 22 of the pegboard. In the unlocked and unlatched position, the tapered nose portion 84 of latching shuttle 82 rests against the curved outer surface of latch crossbar 48. Locking base 50 is next further pivoted inwardly towards the pegboard relative to display rod 30 about pivot crossbar 46 to the locked and latched position shown in FIG. 3 such that latching shuttle 82 rides under latch crossbar 48 and compresses biasing spring 86 against the biasing force exerted on the latching shuttle by the biasing spring. When the locking base 50 is fully pivoted from the unlocked position to the locked position and the latching shuttle 82 has passed completely under the latch crossbar 48, the biasing force exerted by biasing spring 86 biases the latching shuttle upwardly behind the latch crossbar into the latched position.

The display hook 10 can be removed from the display support (i.e. pegboard) 20 in the following manner. From the locked and latched position shown in FIG. 3, the actuator 94 of the magnetic key 90 is inserted into the recess 66 formed in the housing 52 of the locking base 50 such that the latching shuttle 82 is magnetically attracted towards the actuator and overcomes the biasing force exerted on the latching shuttle by the biasing spring 86 to the unlatched position shown in FIG. 4. Although the latch mechanism 80 is in the unlatched position, the locking base 50 remains in the locked position in the orientation shown in FIG. 4. In the locked and unlatched position, the locking base 50 can be pivoted outwardly from the pegboard 20 relative to the display rod 30 about the pivot crossbar 46 to the unlocked position shown in FIG. 5 to disengage the second attachment members 74 from the rear surface 24 of the pegboard 20. In the unlocked position, the antlers 72 of the locking base 50 can then be withdrawn through the apertures 26 of the pegboard 20 to disengage the first attachment members 43*a* and 43*b* from the front surface 22 of the pegboard 20, and thereby remove the display hook 10 from the pegboard.

The foregoing has described one or more exemplary embodiments of a merchandise display hook having a pivotable locking base that is configured to pivot inwardly towards a display support relative to a display rod when the locking base is moved from an unlocked position to a locked position, and to pivot outwardly from the display support when the locking base is moved from the locked position to the unlocked position. The foregoing has also described one or more exemplary embodiments of a merchandise display hook having an improved locking base for locking the display hook to a display support, while permitting the display hook to be removed from the display support without removing the items of merchandise displayed on the display hook. The foregoing has also described one or more embodiments of a merchandise display hook having an improved locking base for locking the display hook to a display support that can be removed from the display support without the locking base interfering with an adjacent display hook. While exemplary embodiments of the invention have been shown to provide a full, complete and enabling disclosure of the best mode of practicing the invention, it will be readily apparent to those skilled in the art that various modifications can be made thereto without departing from the spirit and scope of the invention. The foregoing detailed description of exemplary embodiments of the invention and the best mode for practicing the invention are provided for the purpose of illustration only and not for the purpose of limitation. In particular, it is envisioned that equivalent embodiments of the invention well within the skill of an ordinary artisan can be made without departing from the spirit and scope of the appended claims.

That which is claimed is:

1. A merchandise display hook for supporting and displaying items of merchandise on a display support, the display hook comprising:

a display rod having a support end for attachment to the display support;

a locking base pivotally attached to the display rod at the support end for locking the display hook to the display support, the locking base comprising a latching shuttle that is movable between a latched position and an unlatched position and is biased in the latched position by a biasing force exerted on the latching shuttle, the latching shuttle being made of a magnetically attractable material and being operable to be moved from the latched position to the unlatched position by a magnetic key; and first and second attachment members provided at the support end of the display rod, one of the first and second attachment members provided on the locking base and the other of the first and second attachment members provided on the display rod.

2. A merchandise display hook according to claim 1, wherein the first attachment member is configured to engage a front surface of the display support and the second attachment member is configured to engage a rear surface of the display support.

3. A merchandise display hook according to claim 1, wherein the locking base is pivotable inwardly towards the display support relative to the display rod from an unlocked position to a locked position and is pivotable outwardly from the display support relative to the display rod from the locked position to the unlocked position.

4. A merchandise display hook according to claim 3, wherein the locking base and the display rod define a first angle therebetween when the locking base is in the locked position and define a second angle therebetween when the locking base is in the unlocked position.

5. A merchandise display hook according to claim 4, wherein the first angle is greater than the second angle.

6. A merchandise display hook according to claim 1, wherein the locking base is configured to pivot relative to the display rod between an unlocked position and a locked position.

7. A merchandise display hook according to claim 6, further comprising a pivot crossbar rigidly attached to the display rod and wherein the locking base pivots relative to the display rod about the pivot crossbar.

8. A merchandise display hook according to claim 6, wherein the locking base defines a contact surface configured to engage a front surface of the display support in the locked position.

9. A merchandise display hook according to claim 6, wherein the second attachment member is configured to move relative to the display rod when the locking base is moved between the locked position and the unlocked position.

10. A merchandise display hook according to claim 1, further comprising a latch crossbar rigidly attached to the display rod and wherein the latching shuttle is disposed between the latch crossbar and a front surface of the display support in the latched position.

11. A merchandise display hook for supporting and displaying items of merchandise on a display support, the display hook comprising:

a display rod having a support end for attachment to the display support;

a locking base pivotally attached to the display rod at the support end for locking the display hook to the display support, the locking base comprising a latching shuttle that is movable between a latched position and an unlatched position and is biased in the latched position by a biasing force exerted on the latching shuttle; and first and second attachment members provided at the support end of the display rod, one of the first and second attachment members provided on the locking base and the other of the first and second attachment members provided on the display rod;

wherein the latching shuttle is moved from the latched position to the unlatched position by a magnetic force field sufficient to overcome the biasing force exerted on the latching shuttle.

* * * * *